US007564225B2

(12) United States Patent
Moraveji et al.

(10) Patent No.: US 7,564,225 B2
(45) Date of Patent: Jul. 21, 2009

(54) LOW-POWER VOLTAGE REFERENCE

(75) Inventors: Farhood Moraveji, Saratoga, CA (US); Michael Hsing, Saratoga, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 374 days.

(21) Appl. No.: 11/237,158

(22) Filed: Sep. 28, 2005

(65) Prior Publication Data

US 2007/0069700 A1 Mar. 29, 2007

(51) Int. Cl.
*G05F 3/16* (2006.01)
*G05F 1/613* (2006.01)

(52) U.S. Cl. ..... 323/223

(58) Field of Classification Search ..... 323/223, 323/224, 273, 280, 282, 314–316; 327/530, 327/535, 537–543; 330/259, 261
See application file for complete search history.

(56) References Cited

U.S. PATENT DOCUMENTS 5,939,867 A * 8/1999 Capici et al. ..... 323/280
6,259,238 B1 * 7/2001 Hastings ..... 323/280

* cited by examiner

*Primary Examiner*—Akm E Ullah
*Assistant Examiner*—Jue Zhang
(74) *Attorney, Agent, or Firm*—Perkins Coie LLP

(57) ABSTRACT

A circuit provides a voltage reference using very low power. It can also be used as a shut regulator for a quiescent current as low as 1.5 μA. It includes a transconductance amplifier, a gain stage, and a power transistor. One embodiment of this invention utilizes a work function difference between $p^+$ gate and $n^+$ gate to generate a predetermined reference voltage. In another embodiment of this invention, the predetermined reference voltage can be pre-adjusted using gate materials with different work functions.

16 Claims, 5 Drawing Sheets

$I_{min}$= Minimum amount of current needed to start regulation (1.5 μA)
$I_{max}$= Maximum amount of current the shunt regulator can regulate ( 40mA or more)
V=change of reference voltage when current changes from $I_{min}$ to $I_{max}$.

LOW-POWER VOLTAGE REFERENCE

FIELD OF INVENTION

The invention relates to a voltage reference circuit consuming very low power, and more particularly, relates to a reference voltage generator that can operate under very low current supply and simultaneously keep its output voltage constant over variable temperatures.

BACKGROUND INFORMATION

Nowadays, many electronic devices are built by connecting together electrical components, ranging from a few electrical components in simple circuits to millions of them in complex circuits. Low power consumption has become one of the main issues in the electronics industry for many product areas such as cellular phones, biomedical implants, digital watches, calculators, tape players, portable computers, LCD driver circuits, in short, all types of portable and battery powered electronic devices.

For example, along with the recent increase in the popularity of portable equipment, the requests for large-scale integrated (LSI) devices performing battery operations are increasingly varied. Lowering the operating current (power supply current) to dramatically extend the operating time of battery operated systems is desirable.

Migrating to low operating voltages, denoted commonly as $V_{cc}$ or $V_{dd}$, such as lower than 0.9 V is widely desired. Many traditional reference voltage circuits cannot meet this low voltage reference requirement. In some other reference circuits, such as the bandgap reference voltage generator shown in U.S. Pat. No. 4,628,248 by Birrittella et al, the current needed to activate the reference voltage generator results in high power consumption, due to use of bipolar transistors, e.g., $I_B$ and $V_{BE}$. The quiescent current $I_Q$ may reach a very high value, i.e., the value of the current supply that is necessary to operate the shunt regulator may be too big. Typically, the value of the quiescent current used to correctly bias the reference voltage generator is at least several decades, such as 50-60 μA.

The bandgap reference voltage generator has the disadvantage of high power consumption. Thus, developing a type of shunt regulator other than the bandgap reference voltage generator is desired.

SUMMARY

The present invention provides a reference voltage generator (shunt regulator) that is able to generate very low voltage on its output terminal with very low quiescent current, such as 1.5 μA or less. The output reference voltage equal to a bandgap voltage, thus enabling the circuit to consume little power. The magnitude of the quiescent current and reference voltage is only an example and those values can be modified by the designer of the reference voltage generator.

The present invention utilizes the work function difference between gate terminals of an input terminal transistor pair, to generate a predetermined reference voltage, which can be adjustable. The bulk of the reference circuit consists of a transconductance amplifier where its input offset is set to be the same as the magnitude of the reference voltage. This can be done, for example, by using a pair of MOS transistors as the input terminal transistor pair. The gate terminals are made of different types of polysilicon materials. In particular, one of the gate-terminals of the pair of MOS transistors is made of $p^+$ polysilicon material, and the other gate-terminal of the pair of MOS transistors is made of $n^+$ polysilicon material. Transistors with different kinds of gate materials with the same size (aspect ratio) will have different work function values. The circuit according to the present invention amplifies the work function difference between gate terminals of the input terminal transistor pair. Due to the characteristic of work function, the output reference voltage of the circuit in the present invention can maintain a very stable value.

BRIEF DESCRIPTION OF THE DRAWINGS

The following figures illustrate embodiments of the invention. These figures and embodiments provide examples of the invention and they are non-limiting and non-exhaustive.

DETAILED DESCRIPTION

Embodiments of a system and method that uses a reference voltage generator as a shunt regulator are described in detail herein. In the following description, some specific details, such as example circuits are included to provide a thorough understanding of embodiments of the invention. One skilled in relevant art will recognize, however, that the invention can be practiced without one or more specific details, or with other methods, components, materials, etc.

The invention discloses the configuration of a circuit of a shunt regulator, which is a very low-power reference voltage generator mainly utilizing MOSFETs. The reference circuit includes a transconductance amplifier, where its input offset is set to be the same as the magnitude of the reference voltage. This is done by using a pair of MOS transistors with their gate terminals formed from different kinds of polysilicon materials. The gate-terminal of one transistor of the pair of MOS transistors is made of $p^+$ poly, and the gate terminal of the other transistor of the pair of MOS transistors is made of $n^+$ poly. Transistors with the same gate size, but different kinds of gate material, will have different work functions. Accordingly, this invention takes advantage of this configuration to generates a stable reference voltage by amplifying the work function difference to set $V_{ref}$.

Figure 1:
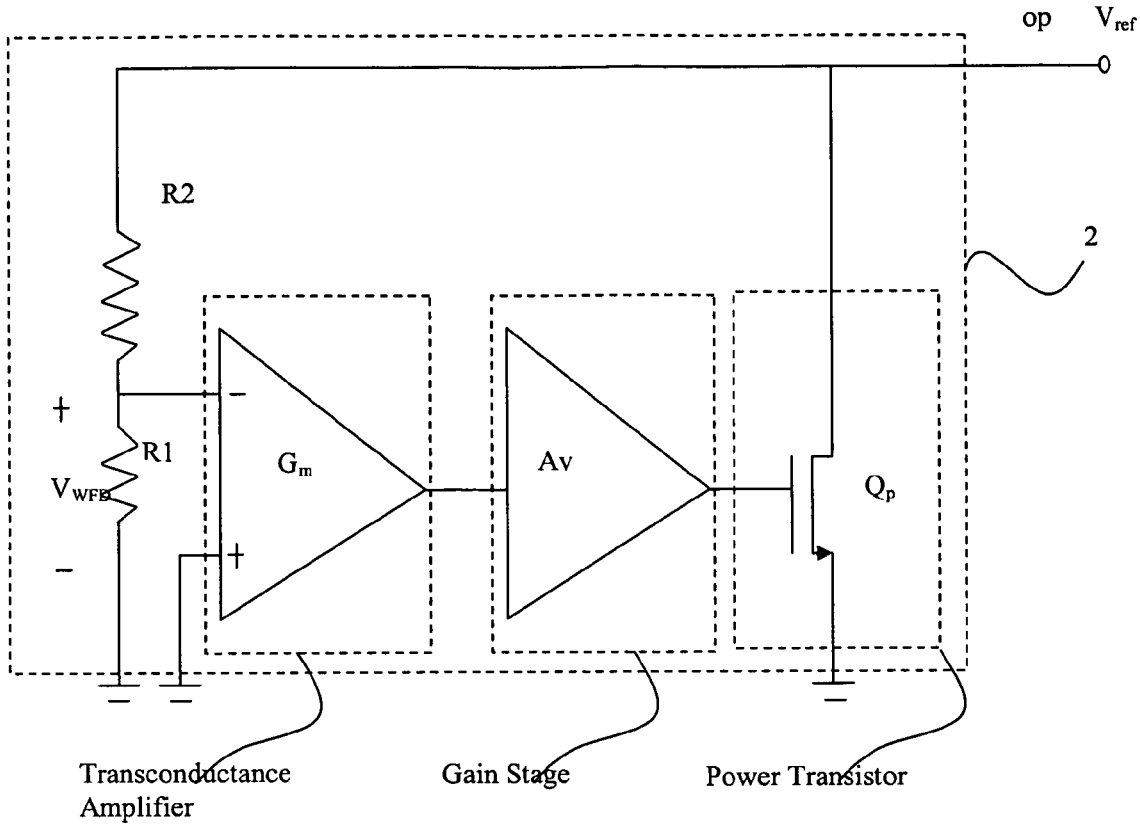
FIG. 1 is a schematic view of the block diagram of a reference voltage generator (shunt regulator) in one embodiment of this invention.

In FIG. 1, the work function difference ($V_{WFD}$) can be expressed as the following equation:

$$V_{WFD} = (\text{work function of } PMOS \text{ with } p^+ \text{ poly gate}) - (\text{work function of } PMOS \text{ with } n^+ \text{ poly gate}) \quad (1)$$

FIG. 1 schematically illustrates a circuit diagram of a reference voltage generator 2 according to one embodiment of this invention, in which the work function difference $V_{WFD}$ is applied across a resistor R1 coupled to the input terminals of a transconductance amplifier. Thus, a first terminal of the resistor R1 is connected to the negative input of the transconductance amplifier and the second terminal of the resistor R1 (along with the positive input of the transconductance amplifier) is connected to ground. In other embodiments, ground can be replaced with a different common voltage level.

The transconductance amplifier is a part of the reference voltage generator 2 with transconductance value Gm. The output voltage of the transconductance amplifier is input to a gain stage Av, and the output voltage of the gain stage Av drives a power transistor $Q_P$. The power transistor $Q_P$ regulates the shunt current and also sets the final output voltage $V_{ref}$. The drain terminal of the power transistor is connected to the negative input terminal of the transconductance amplifier Gm through a resistor R2. Thus, a first terminal of the resistor R2 is connected to the drain terminal of the power transistor $Q_P$ and a second terminal of the resistor R2 is connected to the negative input of the transconductance amplifier.

Accordingly, the desired reference voltage $V_{ref}$ can be obtained from the following equation:

$$V_{ref}=V_{WFD}[1+(R2/R1)] \quad (2)$$

Figure 2:
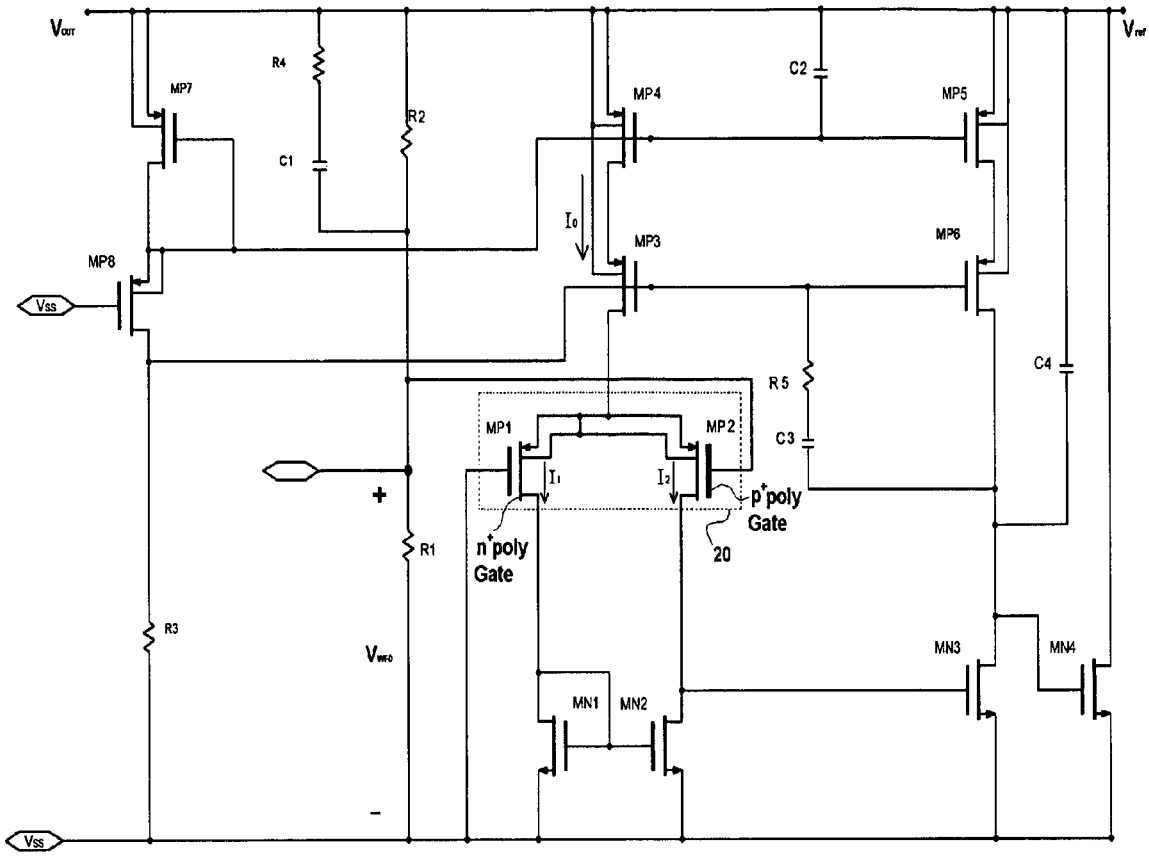
FIG. 2 schematically illustrates the circuit diagram according to one embodiment of this invention, in which a reference voltage generator (shunt regulator) utilizes a PMOS input terminal transistor pair (gate terminals respectively made of $p^+$ and $n^+$ polysilicon materials) as a part of a transconductance amplifier in the reference voltage generator's input stage.

FIG. 2 depicts the detail schematic view of one embodiment of this invention, in which MP1 and MP2 represent the input terminal transistor pair. Particularly, to implement the feature of this invention, in this embodiment, the transistor MP1's gate terminal is made of $n^+$ poly, and transistor MP2's gate terminal is made of $p^+$ poly. The tail current ($I_0$) of the input terminal transistor pair is set by the cascode current source (including a transistor MP3 and a transistor MP4). The tail current $I_0$ is divided to $I_1$ and $I_2$, which flow through the transistor MN1 and the transistor MN2, respectively. The transistors MN1 and MN2 have the same size (aspect ratio) and form a simple current mirror (MN1, MN2). Since $I_1$ and $I_2$ are forced through a balanced current mirror, the magnitude of $I_1$ and $I_2$ should be the same: $I_0/2$. By examining the circuit, $I_0=I_1+I_2$, and $I_1=I_2=(½)I_0$. The action of current mirror MN1 and MN2 balances the currents in the input terminal transistor pair. Furthermore, both transistors MN1 and MN2 operate in the saturation region. The gate-to-source voltage of a transistor in saturation region can be obtained from the following equation:

$$V_{GS}=V_T+(I_D/K)^{(1/2)} \quad (3)$$

In equation (3), $V_T$ is the magnitude of threshold voltage, $I_D$ is the drain current, and K is the conduction factor of the device which can be written as $K=(½)(W/L)\mu C_{ox}$, where μ is the mobility of carrier in the device, $C_{ox}$ is equal to [(gate oxide capacitance)/(unit area)], W is the width of the device, and L is the length of the device. In view of equation (3), the gate-to-source voltage of MP1 and MP2 will be obtained and expressed as following equations:

$$V_{GSMP1}=V_{TMP1}+[(½)I_0/(K_p)]^{(1/2)} \quad (4)$$

$$V_{GSMP2}=V_{TMP2}+[(½)I_0/(K_p)]^{(1/2)} \quad (5)$$

By subtracting the gate-to-source voltage of transistor MP1 from transistor MP2, the result named as $V_{GSMP1\text{-}MP2}$ can be derived from the following equation:

$$\Delta V_{GSMP1-MP2} = \{V_{TMP2} + [(1/2)I_0/(K_p)]^{(1/2)}\} - \{V_{TMP1} + [(1/2)I_0/(K_p)]^{(1/2)}\} = V_{TMP2} - V_{TMP1} \quad (6)$$

Equation (6) shows that the gate-to-source voltage difference between the input terminal transistor pair is the same as the threshold voltage difference between the transistors MP2 and MP1 if neglecting the secondary effects. In addition, if the foregoing transistors are made of identical transistors with the same gate material, then the resulted voltage from equation (6) would be equal to the difference of threshold voltages or threshold voltage matching, and in normal case will be in the millivolt range, which is called the input offset voltage of the input terminal transistor pair.

However, since the gate material of the transistor MP2 is different from that of the transistor MP1, the gate-to-source voltage difference between MP1 and MP2 is much higher than the millivolt range and will be determined by the work function difference of $p^+$ gate terminal (of MP2) and $n^+$ gate terminal (of MP1). The equation for the threshold voltage of a regular MOS transistor can be expressed as the following equation:

$$V_T=\Phi_{WF}+(Q_B/C_{ox})-2\Phi_B+(Q'_{eff}/C_{ox}) \quad (7)$$

In equation (7), $\Phi_{WF}$ is the work function difference between gate and silicon material (body), $Q_B$ is total bulk charge, $\Phi_B$ is the body's potential, $Q_{eff}$ is the total charge in oxide-silicon and insulator interface. If only the gate material changes while all other parameters in equation (7) remain unchanged, threshold voltage $V_T$ varies by the amount of work function change of gate material. By definition, work function is the amount of energy needed to move an electron from its Fermi level to its free state level. For a p type material, work function is $\Phi_P$:

$$\Phi_P=4.59+(KT/q)\ [\ln(N_a/n_i)] \quad (8)$$

For a n type material, work function is $\Phi_N$:

$$\Phi_N=4.59-(KT/q)[\ln(N_d/n_i)] \quad (9)$$

So the work function difference between a p and a n type material will be:

$$\Phi_{PN}=(KT/q)[\ln(N_aN_d/n_i^2)] \quad (10)$$

In equation (10), if both n and p become degenerated materials, i.e., doping density in the semiconductor material becomes very high, then the work function difference between p and n type material, i.e., $\Phi_{PN}$, becomes the bandgap voltage.

This voltage is fixed over a wide range of temperatures. In the present invention, it is desired to design a voltage reference by taking advantage of this concept, using a MOS transistor with its gate terminal made of $p^+$ poly and the other MOS transistor with its gate terminal made of $n^+$ poly. As previously described, if the two transistor are forced to have the same current and $V_{DS}$ voltage (drain-source voltage), then their gate-to-source voltage difference, denoted as $\Delta V_{gs}$, will be equal to the difference between their threshold voltage $\Delta V_T$ which can be expressed in the following equation:

$$\Delta V_T=V_{Tp+gate}-V_{Tn+gate} \quad (11)$$

From equation (11), if $V_{Tp+gate}$ and $V_{Tn+gate}$ are replaced with its expression according to equation (7), then $\Delta V_T$ can also be expressed as the following equation:

$$\Delta V_T = [\Phi_{WF(p+Silicon)} + Q_B / C_{ox} - 2\Phi_B + Q'_{eff} / C_{ox}]_{p+gate} - [\Phi_{WF(n+Silicon)} + Q_B / C_{ox} - 2\Phi_B + Q'_{eff} / C_{ox}]_{n+gate} \quad (12)$$

Because the parameters are the same for both the $p^+$ silicon or $n^+$ silicon, equation (12) can be reduced to the following equation:

$$\Delta V_T = \Phi_{WFp+Silicon} - \Phi_{WFn+Silicon} \quad (13)$$

$$= (\Phi_{WFp+} - \Phi_{WFSilicon}) - (\Phi_{WFn+} - \Phi_{WFSilicon}) \quad (14)$$

$$= \Phi_{WFp+} - \Phi_{WFn+} \quad (15)$$

Turning back to equation (13), the parameter $\Phi_{WFp+Silicon}$ is the work function difference between p+ poly and bulk silicon, and the parameter $\Phi_{WFn+Silicon}$ is the work function difference between n+ poly and bulk silicon. Subsequently, from the previous explanation of equation (13) through equation (15), the threshold voltage difference is equal to the work function difference between the $p^+$ poly and $n^+$ poly, which are respectively used to form the gate terminals of the input terminal transistor pair 20 of the transconductance amplifier.

In FIG. 2, as previously explained, the input terminal transistor pair 20 (including transistors MP1 and MP2) forces the difference of threshold voltages ($\Delta V_T$), which was previously named as $V_{WFD}$ earlier, across resistor R1. If for any reason, this voltage tends to deviate from its original value, the transconductance amplifier, which consists of transistors MP1, MP2, MP3, MP4, MN1, and MN2, will servo the gate of transistor MN3. In FIG. 2, a transistor MN3 together with transistors MP5 and MP6 (which act as current source for MN3) forms a gain stage (Av in FIG. 1) gaining up the error. This in turn will servo the gate of a power transistor MN4 ($Q_P$ in FIG. 1). This servo action will change the total current from the main supply source in such a way that the generated reference voltage $V_{ref}$ stays constant, and the constant value of the voltage $V_{ref}$ can be shown as the following equation:

$$V_{ref}=[1+(R2/R1)]V_{WFD} \quad (16)$$

In FIG. 2, transistors MP7 and MP8 together with a resistor R3 set the bias current for the overall circuit. Capacitor C2 bypasses the gates of those transistors, which act as a current mirror. In addition, a resistor R5, together with capacitors C3 and C4, create a pole-zero for the stability of the part. Capacitor C1 and a resistor R4 are used to perform feed forward compensation.

Figure 3:
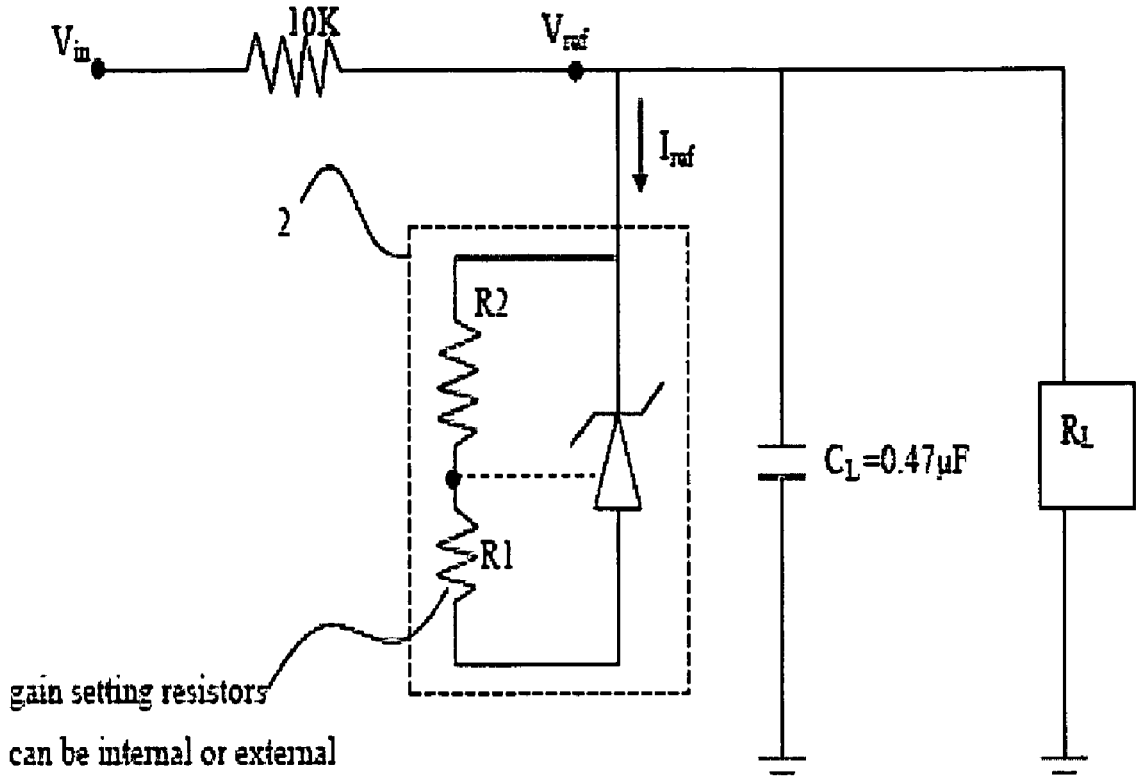
FIG. 3 depicts one of the typical applications of a shunt regulator, in which a compensating capacitor and a load are connected to the shunt regulator, and resistors R1 and R2, which can be internal or external, set the desired voltage.

FIG. 3 depicts a typical application of this reference. The gain setting resistors R1 and R2 can be manufactured internally or externally to the integrated circuit of the reference voltage generator 2. The reference voltage generator 2 can be either a two-terminal or a three-terminal device, which depends on whether the resistors R1 and R2 are placed internally or externally.

Figure 4:
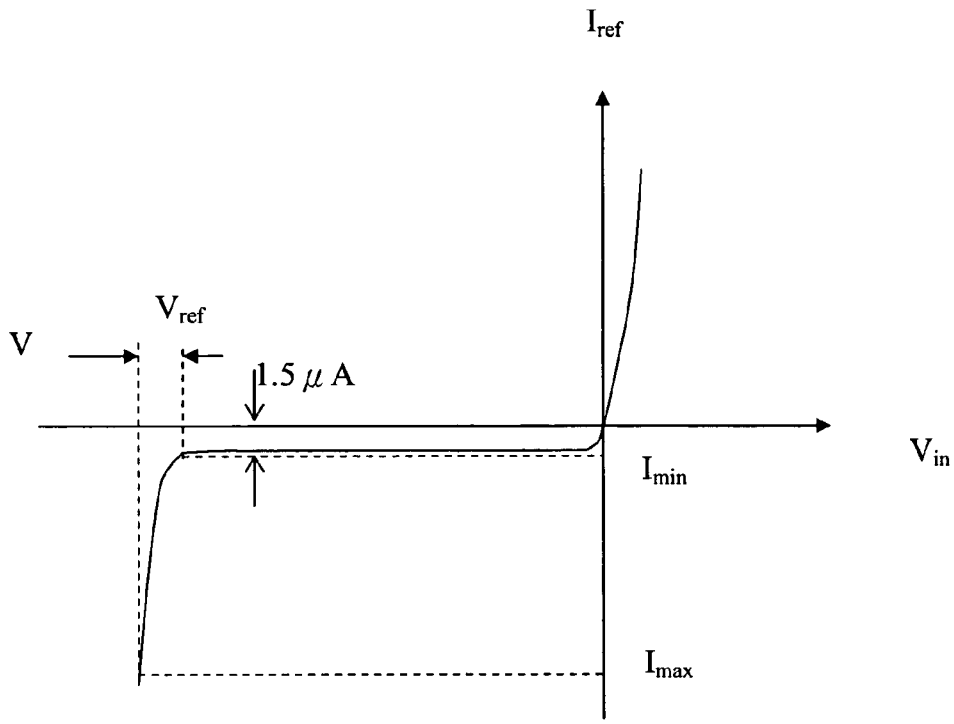
FIG. 4 schematically illustrates the plot of reference current ($I_{ref}$) versus input voltage ($V_{in}$) of the reference voltage generator illustrated in FIG. 3.

FIG. 4. shows the current versus voltage behavior of one embodiment of this invention. As the voltage generator 2 starts to regulate current, its impendence is very low. The impedance can be lower than one ohm. The value of the impedance of the shunt regulator depends on the size of the power transistor MN4 (FIG. 2). The circuit can be designed such that the power transistor MN4 is capable of sinking more than hundreds of mA of current while still maintaining very good load regulation.

Figure 5:
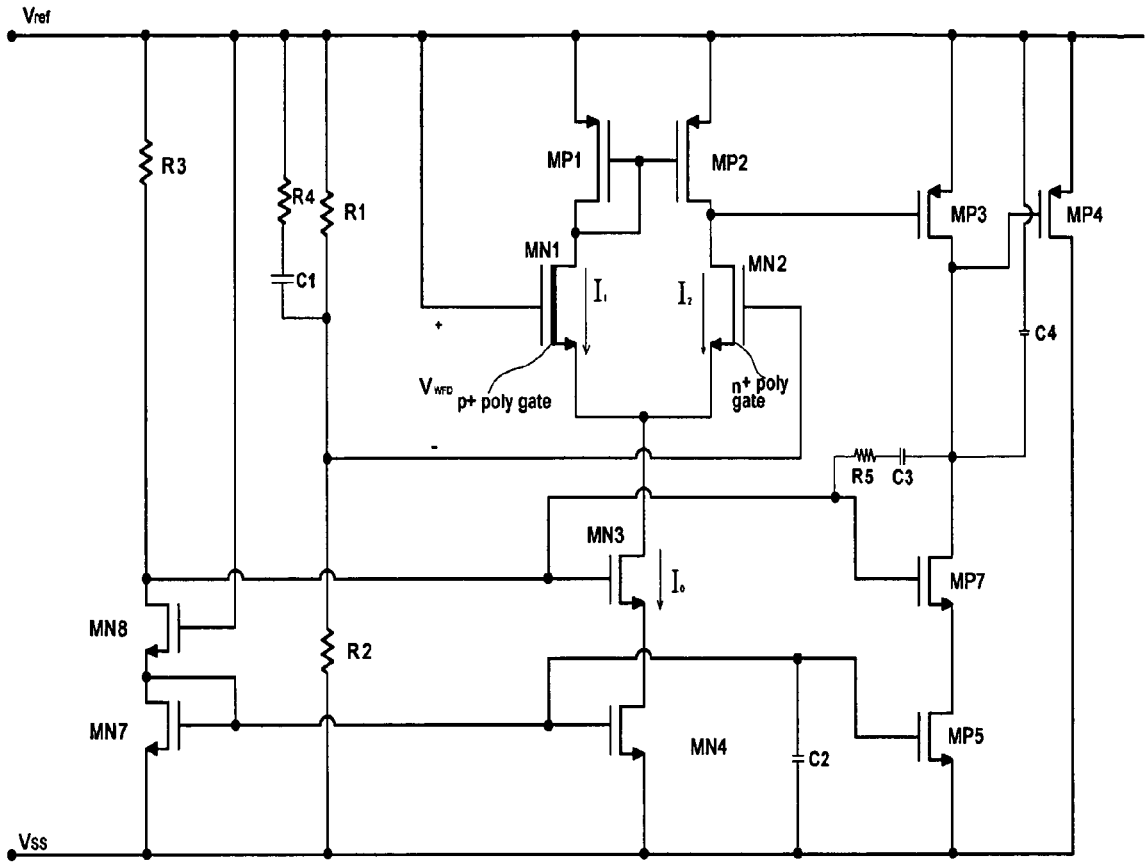
FIG. 5 schematically illustrates a circuit diagram according to another embodiment of this invention, in which a reference voltage generator (shunt regulator) utilizes a NMOS input terminal transistor pair (gate terminals respectively made of $p^+$ and $n^+$ polysilicon materials) as a part of a transconductance amplifier in the reference voltage generator's input stage.

FIG. 5 shows another embodiment of a low-power reference voltage generator (shunt regulator) 2, in which a transconductance amplifier includes NMOS transistors NM1 and NM2, whose gate terminals are made of $p^+$ poly and $n^+$ poly materials, respectively. The work function difference between the gate materials is applied across resistor R1, which is referenced to an output voltage. In addition, the reference voltage is set proportional to the work function difference of the input terminal transistor pair identified as an input offset voltage.

Turning back to FIG. 2, the circuit according to one embodiment of the present invention can be used to generate a reference voltage consuming very low power. The circuit can maintain the generated reference voltage at a very stable value. The circuit according to one embodiment of this invention at least includes the following elements: a resistor set, a transconductance amplifier (an input terminal transistor pair 20 with an accompanied current mirror and a pair of loading transistors), a gain stage (MN3 with another accompanied current mirror), and a power transistor MN4. The resistor set at least includes a first resistor R1 and a second R2.

The input terminal transistor pair applies a work function difference across the first resistor R1. The second end of the first resistor R1, being connected to the frist end of the second resistor R2, is electrically coupled to the negative input terminal of the transconductance amplifier, which is the gate terminal of the transistor MP2. According to one embodiment of this invention, the input terminal transistor pair at least includes a transistor MP1 and a transistor MP2, the transistor MP1 has the same size as the transistor MP2. The gate terminals of the transistor MP1 and the transistor MP2 are made of polysilicon materials heavily doped with n type dopant and p type dopant, respectively. In addition, the gate terminals of the transistor NP1 and the transistor MP2 are respectively coupled to both ends of the resistor R1, and the body of the transistor MP1 is electrically coupled to the body of the transistor MP2. The gate terminal of the transistor MP2 is the negative input terminal of the transconductance amplifier. Transistors MP4 and MP3 provide bias current to transistor pair MP1 and MP2 in the transconductance amplifier. The drain terminal of the transistor MP3 is coupled to the source terminal of the transistor MP1 and the source terminal of the transistor MP2, the source terminal of the transistor MP3 is coupled to the drain terminal of the transistor MP4, in addition, the body of the transistor MP3 is coupled to the body of the transistor MP4. The transconductance amplifier also includes a pair of loading transistors (including a first loading transistor MN1 and a second loading transistor MN2). The gate terminals of the transistor MN1 and the transistor MN2 are electrically coupled to the drain terminal of the transistor MN11.

According to one embodiment of this invention, the gain stage amplifies the output voltage of the transconductance amplifier. The gain stage comprises a third current source (including transistors MP5 and MP6) and a gain stage transistor MN3. The drain terminal of the transistor MP5 is coupled to the source terminal of the transistor MP6, the body of the transistor MP5 is coupled to the body of the transistor MP6. In addition, the gate terminal of the transistor MN3 is coupled to the drain terminal of the transistor MN2 and to the drain terminal of the transistor MP2, furthermore, the drain terminal of the transistor MN3 is coupled to the drain terminal of the transistor MP6. According to one embodiment of this invention, the reference voltage generator also includes a power transistor, MN4, which is used to send feedback from the drain terminal of the power transistor MN4 to the negative input terminal of the transconductance amplifier through the second resistor R2 connected in shunt with a compensating circuit. The compensating circuit (including a compensating capacitor C1 cascaded with a compensating resistor R4) is used to perform feed forward compensation. The gate terminal of the power transistor MN4 is electrically coupled to the drain terminal of the transistor MN3. Its drain terminal is connected to the second end of the second resistor. The source terminals of the transistors MN1, MN2, MN3, and the power transistor MN4 are all coupled to the first end of the first resistor R1 and R3.

The description of the invention and its applications as set forth herein is illustrative and is not intended to limit the scope of the invention. Variations and modifications of the embodiments disclosed herein are possible, and practical alternatives to and equivalents of the various elements of the embodiments are known to those of ordinary skill in the art. Other variations and modifications of the embodiments disclosed herein may be made without departing from the scope and spirit of the invention.

We claim:

1. A circuit for generating a stable reference voltage, the circuit comprising:

a first resistor having a first terminal and a second terminal;

a second resistor having a first terminal and a second terminal, the first terminal of the first resistor being coupled to the second terminal of the second resistor;

a transconductance amplifier having a negative input terminal coupled to the first terminal of the first resistor, and a positive input terminal coupled to the second terminal of the first resistor, wherein the transconductance amplifier is configured to establish a threshold voltage difference between first and second input transistors across the first resistor;

a gain stage to amplify the threshold voltage difference between the first and second transistors; and a power transistor having a gate terminal and a drain terminal, the power transistor configured to receive the amplified threshold voltage difference through the gate terminal and send a feedback signal from the drain terminal to the negative input terminal of the transconductance amplifier through the second resistor.

2. The circuit in claim 1 further comprising a current mirror to set an overall bias current for the circuit.

3. The circuit in claim 1 further comprising a compensation circuit coupled between the drain terminal of the power transistor and the negative input terminal of the transconductance amplifier.

4. The circuit in claim 3, wherein the compensation circuit comprises a fourth resistor and a capacitor being connected in series.

5. The circuit in claim 1, wherein the transconductance amplifier provides a first bias current to a first input transistor and a second bias current, with a same value as the first bias current, to a second input transistor, wherein the threshold voltage difference is equal to a work function difference between the first and second transistors, and wherein the first input transistor includes a gate terminal coupled to the first terminal of the first resistor and the second input transistor includes a gate terminal coupled to the second terminal of the first resistor.

6. The circuit in claim 5, wherein the gate of the first input transistor and the gate of the second input transistor have a same gate width over length ratio, and both the first and second input transistors have a same free carrier mobility and gate oxide capacitance.

7. The circuit in claim 5, wherein the gate of first input transistor and the gate of the second input transistor are made of two materials with different work functions.

8. The circuit in claim 7, wherein the gate of one of the first and the second input transistors is made of N+ polysilicon, and the gate of another one of the first and second input transistors is made of P+ polysilicon.

9. The circuit in claim 7, wherein the first and second input transistors comprise PMOS transistors.

10. The circuit in claim 7, wherein the first and second input transistors comprise NMOS transistors.

11. The circuit of claim 5 wherein the transconductance amplifier further comprises:

a loading pair of transistors having same aspect ratios and configured to form a second current mirror to balance the first and second bias currents provided to the first and second input transistors.

12. The circuit in claim 11, further comprising:

a third current mirror to provide a third bias current to the gain stage; and a gain stage loading transistor having a gate terminal coupled to the drain terminal of the second input transistor, a drain terminal coupled to the third current mirror, and a source terminal coupled to the second terminal of the first resistor.

13. The circuit in claim 12, wherein the power transistor is a PMOS transistor having gate terminal coupled to the drain terminal of the gain stage loading transistor, a drain terminal coupled to the first terminal of the second resistor, and a source terminal coupled to the second terminal of the first resistor.

14. The circuit in claim 12, wherein the power transistor is a NMOS transistor having a gate terminal coupled to the drain terminal of the gain stage loading transistor, a drain terminal coupled to the first terminal of the second resistor, and a source terminal coupled to the second terminal of the first resistor.

15. The circuit in claim 1, wherein the first and second resistors are internal parts of the circuit.

16. The circuit in claim 1, wherein the first and second resistors are external parts of the circuit.

* * * * *